US006308841B1

(12) United States Patent
Donnelly

(10) Patent No.: US 6,308,841 B1
(45) Date of Patent: Oct. 30, 2001

(54) HOLDER FOR TAPER'S KNIVES

(76) Inventor: Robert J. Donnelly, 2 Lawrence Dr., No. White Plains, NY (US) 10603

( * ) Notice: Subject to any disclaimer, the term of this patent is extended or adjusted under 35 U.S.C. 154(b) by 0 days.

(21) Appl. No.: 09/651,851

(22) Filed: Aug. 31, 2000

(51) Int. Cl.[7] ..... A47F 5/00
(52) U.S. Cl. ..... 211/70.6; 211/181.1; 211/70.7
(58) Field of Search ..... 211/181.1, 70.6, 211/70.7, 119, 106, 90.02; 248/37.3, 37.6; D6/462, 465; 206/372, 373

(56) References Cited

U.S. PATENT DOCUMENTS

D. 278,196 * 4/1985 Koves ..... D6/465
D. 292,658 * 11/1987 Kester ..... D6/465
D. 367,375 * 2/1996 Vukelich ..... D6/465 X
1,946,711 * 2/1934 Quisenberry .
2,930,486 * 3/1960 Hoover .
4,303,188 * 12/1981 Calabrese ..... 206/372 X
4,318,478 * 3/1982 De Winter ..... 206/373 X
4,345,688 * 8/1982 De Boer ..... 211/70.6
5,611,440 * 3/1997 Moller ..... 211/70.7
5,788,092 * 8/1998 Teeney ..... 211/70.6
6,047,830 * 4/2000 Chang ..... 206/372 X

* cited by examiner

*Primary Examiner*—Robert W. Gibson, Jr.
(74) *Attorney, Agent, or Firm*—Morrison Law Firm

(57) ABSTRACT

A holder for taper's knives is an open grid structure defined by parallel pairs of spaced apart stringer pieces connected together with transverse joiner pieces. Pairs of stringers in an upper tier are aligned with associated pairs of stringers in a lower tier. Some of the stringer pieces sub-divide the slot courses defined by the spaces apart ones of stringers in each pair. Knives are inserted into the slots courses and hang down with a handle of the knife supported on top of the pair stringers. Support legs and carrying handles at opposite ends of the grid structure are constituted from others of the joiner pieces.

4 Claims, 4 Drawing Sheets

HOLDER FOR TAPER'S KNIVES

BACKGROUND OF THE INVENTION

The present invention relates to a holder for taper's tools and more particularly to a holder on which conveniently and surely, may be mounted taper's knives in plural number and different sizes.

U.S. Pat. No. 4,303,188 discloses a taper's knife caddy which comprises a housing having a plurality of longitudinal slits formed in rows from front to back of the housing to insertably receive the blade portion of the taper's tools. The knife or blade part of the tool is taught as being held by friction when so inserted in the housing. The caddy also includes a removable section which can be used to carry a few knives from the main housing section stored at a location remote from the job site to the site where same will be used.

There are certain disadvantages in the patented holder. For one thing, it appears that the tool receptive slits are not spaced sufficiently apart leading to the possibility of handles of knives inserted in adjacent slits being abutting one with another. This condition can result in bending of the knife blades within the housing since the handles may not house in alignment with its associated blade.

Further, the housing does not allow quick identification to the artisan when he is looking to select a particular needed size of knife since only the knife handles are visible and at least some of different sizes of knives have handles of same or very similar size and shape.

Additionally, the housing construction with a base section and a removable section is unnecessarily expensive to produce for the purpose of service involved since a simpler, more easily and cheaply made holder is can be used.

OBJECTS AND SUMMARY OF THE INVENTION

An object of the invention is to provide a holder for taper's tools which enables a selection of different sizes of tools to be carried in a compact open structured holder, the tools readily being visible to the taper for selecting a particular size of tool needed when needed at the work location.

Another object is to provide a tool holder that holds a taper's knife with the blade thereof oriented straight without risk of causing any bend in the flat configuration thereof.

A further object is to provide a tool holder that is easy to carry because of its compact size.

Another object is to provide a tool holder in which blade reception slots are prided with abutment members to define a reception slot length specific to a given one of taper's knive widths so that sliding of the blade lengthwise of the slot is obviated.

A still further object is to provide a holder which provides a stabilized support of the blade received in a slot at at least two spaced vertical locations on the blade therewith to preclude swinging movement of the knife if the holder is moved as when transporting same from one to another location.

In accordance with the invention, the holder comprises an open grid structure defined by longitudinal, parallel disposed stringers connected together with transverse joiner pieces. The grid structure has at least two support tiers, each tier being defined by pairs of spaced apart stingers, the stringer pairs extending spaced from front to rear of the grid. Each pair of stringers defines a tool blade reception slot.

At least some of the joiner pieces bridge the slot of some of the stringer pairs in at least one tier to define slot lengths in said some stringer pairs which are associated with blade widths of different sizes of tapers's tools which can be inserted in the holder.

The paired stringers of one support tier are each aligned with a corresponding pair of stringers in a other of said support tiers. The alignment arrangement provides that when a blade is inserted in the holder, it will be supported such that two points of grid structure act to prevent any undesirable swing or deflection of the blade can occur when mounted in thee holder.

Some of the joiner pieces are located at opposite ends of such structure, these joiner pieces being connected with tip ends of each stringer piece pairs in each support tier.

Certain of the joiner pieces are connected the joiner pieces connected to the stringer pairs tip ends. These certain joiner pieces extend above and below the support tiers stringer pairs tips ends therewith defining support legs and carrying handles for the holder.

The above and other objects, features and advantages of the invention will become apparent from the following description read in conjunction with the accompanying drawings, in which like reference numerals designate the same elements of the invention.

DESCRIPTION OF THE PREFERRED EMBODIMENTS

Figure 1:
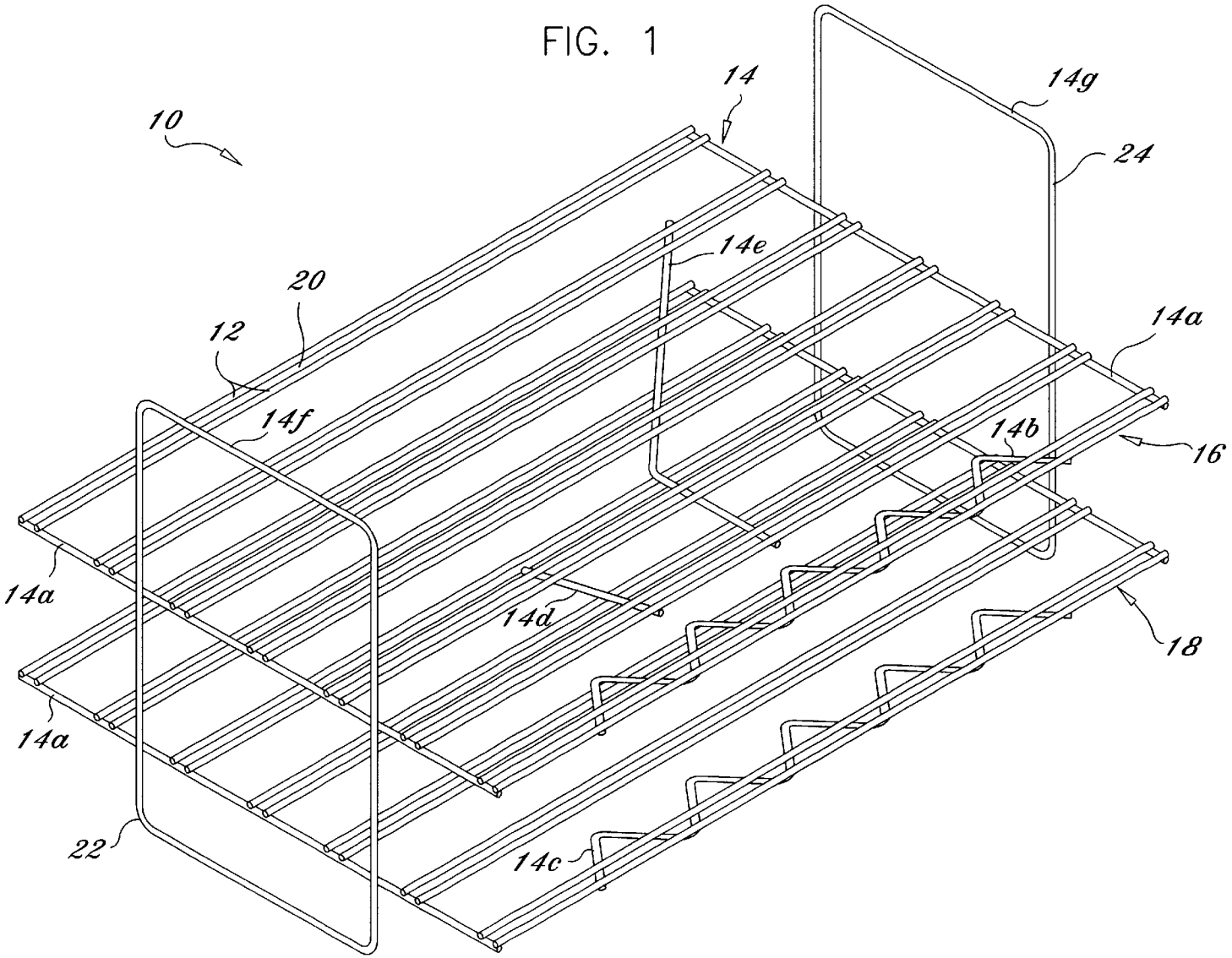
FIG. 1 is a left front side perspective view of a holder for taper's tools made in accordance with the invention.

Referring to FIG. 1, the holder 10 is an open grid structure of integrated wire or rod-like members, which has the advantage that the several ones of taper's tools carried therein are readily visible to the workman facilitating immediate selection and retrieval of a particular tool when needed at the work site without having to pause to recollect in which slit of a holder, e.g., of the type of the above noted patent the sought tool is located. Further, the holder 10 is light in weight, easy to handle and is of compact size while possessing capacity to hold a wide selection of sizes of tools.

In actual embodiment, the holder is about 14 inches long, 10 inches deep and about 8 inches high. It is therefore, most conveniently stowed in a workman's truck. The holder 10 is designed such as to hold a plurality of taper's knives of sizes in a range of 14 inch blade width down 1 and ½ inch in width.

Continuing with reference to FIG. 1, the holder 10 is comprised of a plurality of longitudinally, parallel disposed stringers 12, connected together by transverse joiner pieces 14. Connection can be, e.g., by tack welding of the members one with another. The stringers 12 are arrayed in pairs, the pairs being spaced apart from front to rear of the grid.

At least two support tiers 16, 18 of the paired stringers 12 are provided, and the pairs in one tier are each aligned with an associated pair in the other support tier. The space between each of the stringers 12 in a pair constitutes a slot 20 into which a tool blade can be inserted when mounting a tool on the holder. Mounted, the tool is held in the holder by gravity alone with the blade situate in the slots of the associated pairs of stringers in each of the support tiers. Presence in the two pairs stabilizes the blade of the tool and obviates any swinging thereof as could effect true planar blade orientation.

The joiner pieces 14 include those 14*a* at each of opposite ends of the stringer pieces 12 in each support tier, being connected to tip ends of such stringer pieces. Joiner pieces 14*b,* 14*c* which are of sinuous plan profile, connect the stringers of the frontmost pair of such in the grid and they serve additionally, to define slot lengths associated with retention of small width blades, it being apparent that up to 7 small width blades can be held in this frontmost pair. The joiner pieces 14*b,* 14*c* are in register one with the other.

Figure 2:
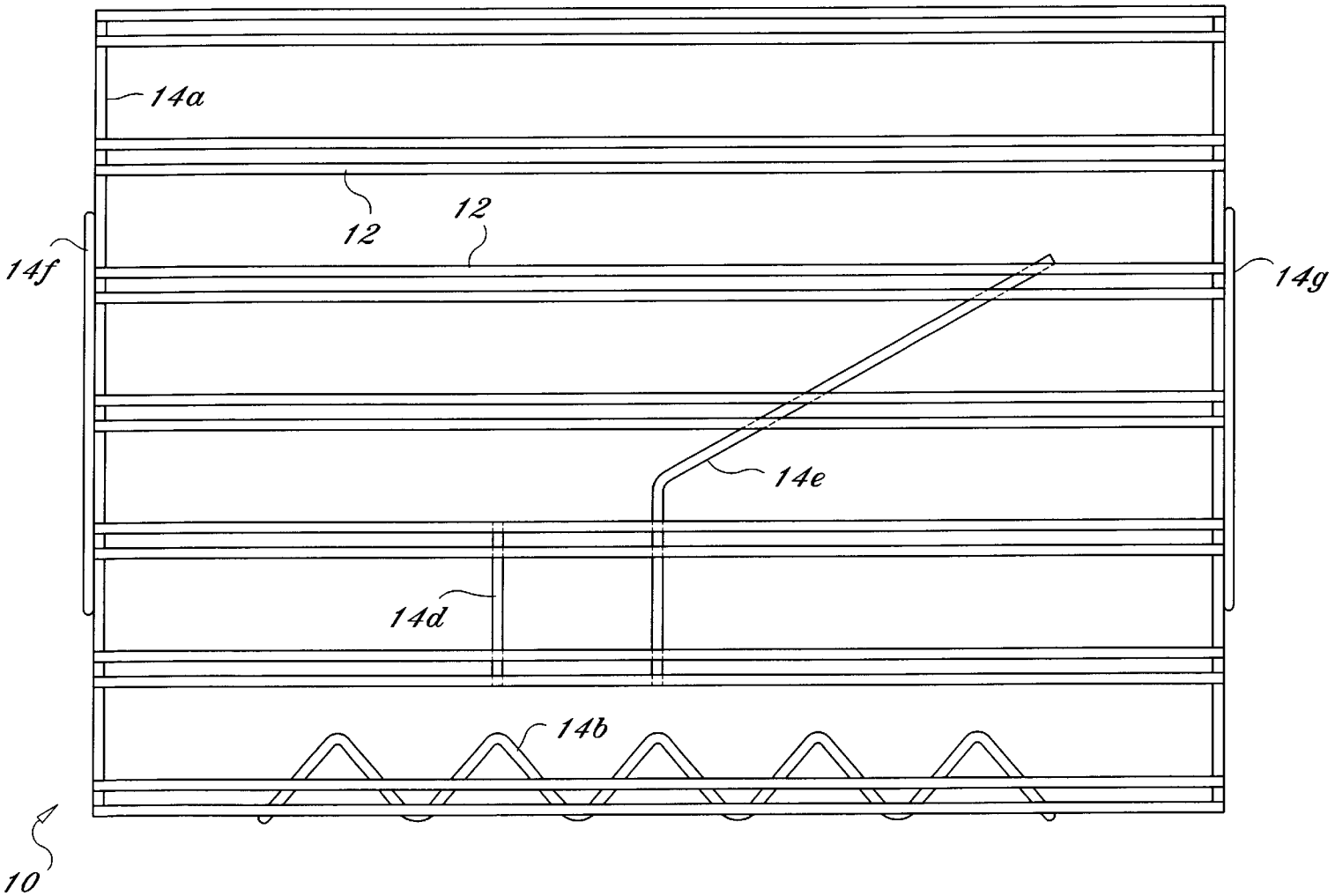
FIG. 2 is a top plan view of the holder.

Another joiner piece 14*d* connects the stringer pieces in the second and third from the grid front pairs of stringers of the upper tier 16. Joiner piece 14*d* defines longer slot course length to the left thereof so that larger tools blades can be received therein. The plan course following of joiner pieces 14*b* and 14*c,* as well as the below noted others is especially evident in FIG. 2.

Joiner piece 14*e* extends in a dog-leg course from the second from rear side stringer piece pair in the upper tier, forwardly connecting together the next 4 encountered pairs of stringer pieces. In following that course, it sub-divides the slots of each into other lengths of slot course associated with reception of varying ones of widths of tool blades.

Joiner pieces 14*f* and 14*g* are employed at each of opposite ends of the grid structure. These are connected to the joiner pieces 14*a* and extend above and below the support tiers 16, 18 so as to provide grid structure legs 22 and carrying handles 24.

Figure 3:
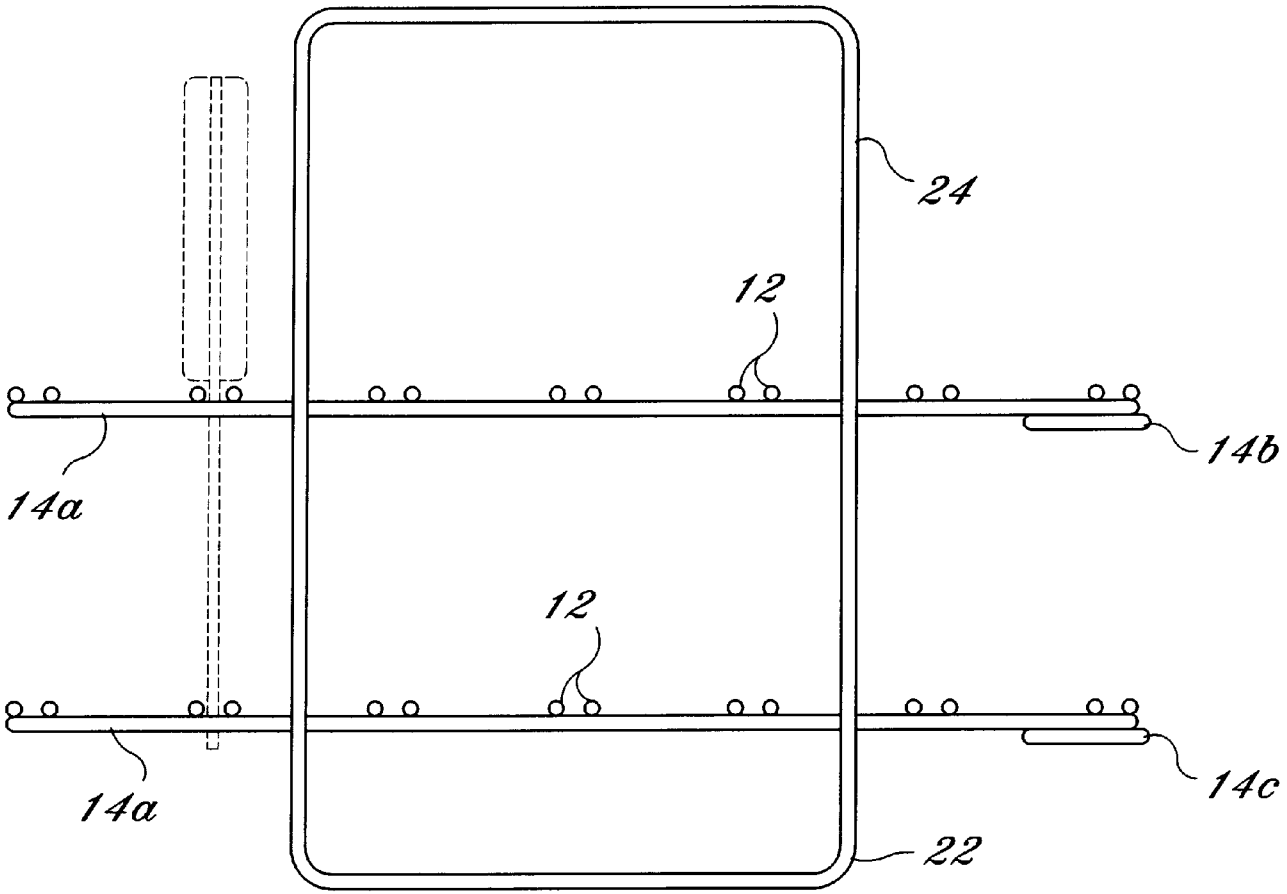
FIG. 3 is a left end elevational view of the holder depicting in phantom view a large taper's knife in received position therein in one of the long slot mounting locations at the rear of the holder.
Figure 4:
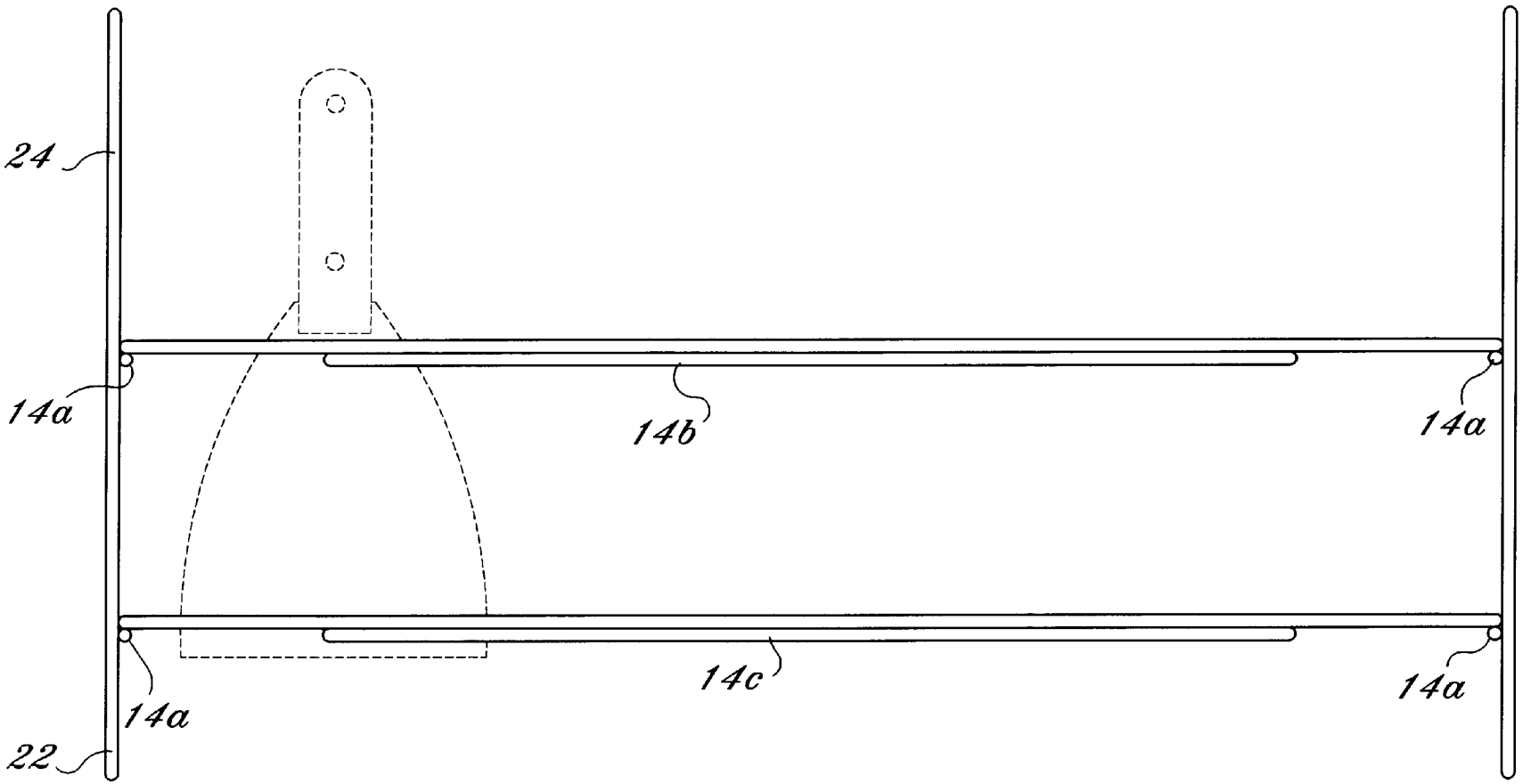
FIG. 4 is a front elevational view of the holder showing in phantom outline, reception of a smaller sized knife in a slot at the front part location in the holder.

FIG. 3. depicts in phantom, mounting of a 12 inch blade tool 24 in the second from rear pair of stringer pieces 12. FIG. 4 shows mounting of a 4 inch blade tool in the third from the front pair of stringer pieces.

Having described a preferred embodiment of the invention with reference to the drawings, it is to be understood that the invention is not limited to this precise embodiment, and that various changes/modifications may be effected therein by one skilled in the art without departing from the scope or spirit of the invention as defined in the appended claims.

What is claimed is:

1. A holder for taper's tools comprising:

a plurality of longitudinally, parallel disposed stringers connected together by transverse joiner pieces;

the connected together stringers and joiner pieces presenting an open grid structure having at least first and second stringer support tiers;

the support tiers comprising pairs of spaced apart stringers, each stringer pair defining tool blade reception slots therebetween; and at least some of the joiner pieces bridging the slot of some of the pairs of stringers in at least one support tier therewith to define slot lengths in said some stringer pairs which are associated with blade widths of different sizes of taper's tools which can be inserted in the holder.

2. A holder in accordance with claim 1 in which the paired stringers of one support tier are each aligned with a corresponding pair of stringers in an other of said support tiers.

3. A holder in accordance with claim 1 in which said joiner pieces include pieces at opposite ends of the grid connected with a pair of tip ends of each of said stringer pairs in each of said support tiers.

4. A holder in accordance with claim 3 in which certain joiner pieces at opposite ends of said grid structure are connected with the joiner pieces connected to the stringer pairs tip ends and extend above and below said support tiers therewith to define support legs and carrying handles for the holder.

* * * * *